United States Patent [19]

Wren

[11] Patent Number: 4,659,028

[45] Date of Patent: Apr. 21, 1987

[54] DISPENSER FOR ROLLED TOILET TISSUE AND LIKE MATERIAL

[76] Inventor: Boyd R. Wren, 305 Berts Dr., Lothian, Md. 20711

[21] Appl. No.: 734,495

[22] Filed: May 16, 1985

[51] Int. Cl.[4] ..... B65H 19/00; B65H 35/10; B65D 85/66; B65D 5/72

[52] U.S. Cl. ..... 242/55.53; 206/408; 206/409; 206/601; 225/106; 229/17 S

[58] Field of Search ..... 242/55.53, 55.54, 55.2; 221/62, 63; 225/106, 46, 47; 206/408, 409, 494, 403, 390, 397, 601, 603, 823; 229/17 S

[56] References Cited

U.S. PATENT DOCUMENTS

| | | | |
|---|---|---|---|
| 843,579 | 12/1907 | Burr et al. | 225/106 |
| 2,440,974 | 5/1948 | Resch | 242/55.55 X |
| 2,806,591 | 9/1957 | Appleton | 229/17 S X |
| 3,523,653 | 8/1970 | Hansen | 242/55.53 |
| 3,627,216 | 12/1971 | Ekuan | 242/55.54 |
| 3,664,594 | 5/1972 | Novak | 206/408 X |
| 3,791,601 | 2/1974 | Broden | 242/55.53 |

FOREIGN PATENT DOCUMENTS

| | | | |
|---|---|---|---|
| 2025366 | 1/1980 | United Kingdom | 225/106 |

*Primary Examiner*—John M. Jillions
*Assistant Examiner*—David Werner
*Attorney, Agent, or Firm*—Krass & Young

[57] ABSTRACT

A portable dispenser for rolled perforated toilet tissues comprising a base adapted to receive a roll in rotatable condition and an outlet structure comprising a tissue-constricting ring through which the tissue is fed and which provided sufficient friction to prevent backup of the tissue into the dispenser. A bill-like projection extends outwardly from the bottom of the aperture or ring to assist in breaking the tissues from one another along a line of perforation. A box-like cover fits over the entire assembly to improve aesthetics.

9 Claims, 6 Drawing Figures

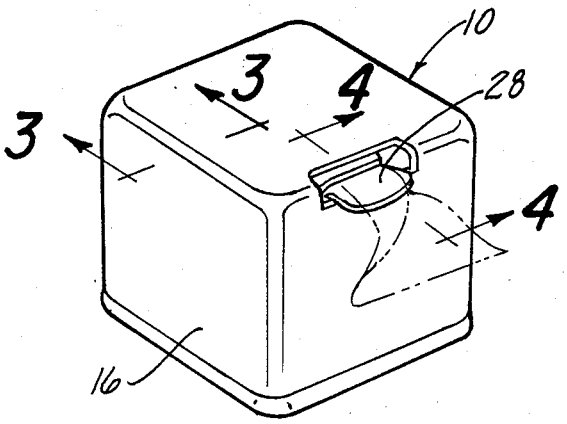
Fig-1
Fig-2
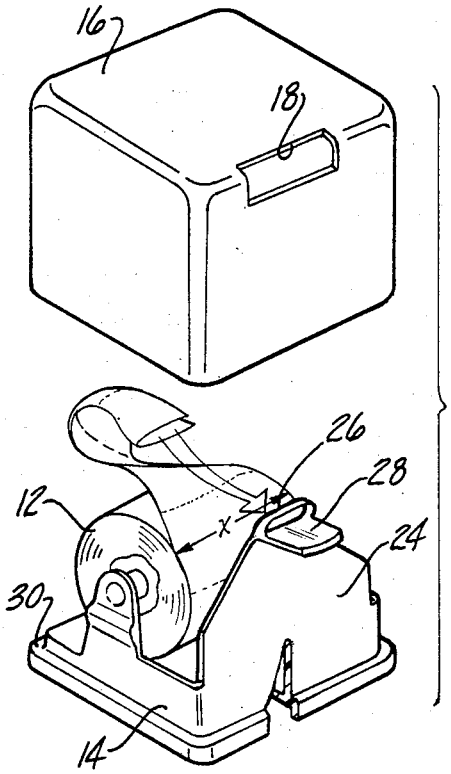
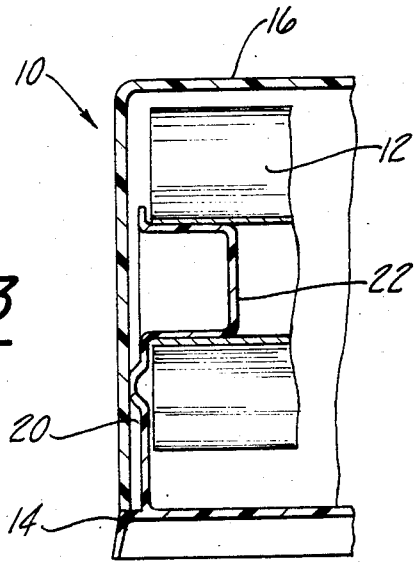
Fig-3
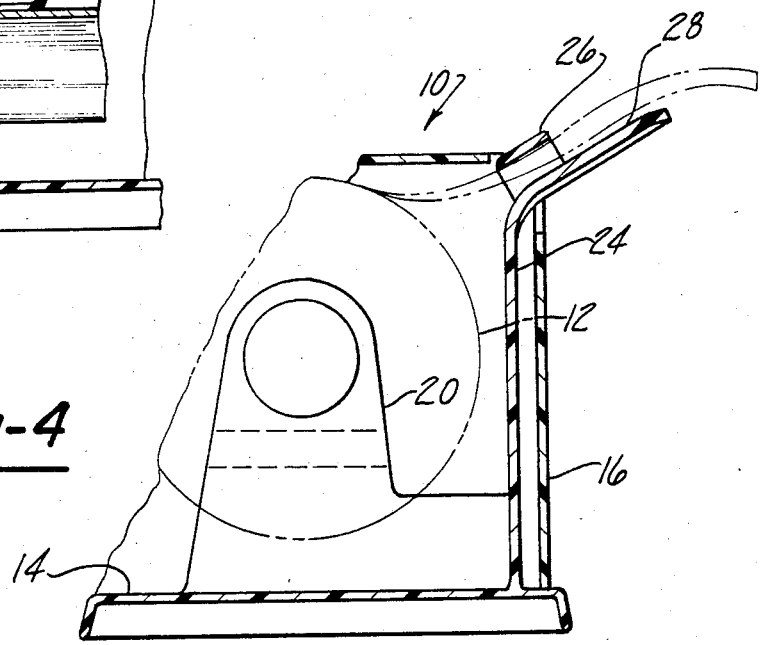
Fig-4

DISPENSER FOR ROLLED TOILET TISSUE AND LIKE MATERIAL

INTRODUCTION

The invention relates to dispensers for rolled paper materials such as toilet tissue.

BACKGROUND OF THE INVENTION

The paper product commonly known as "toilet tissue" is available in two forms: facial tissue is marketed in a stacked, sometimes interleaved, quantity within a box having an outlet in the upper surface, and toilet tissue is typically sold in continuous, albeit periodically perforated, rolls. On a per tissue basis, the facial tissue configuration is considerably more expensive than the rolled or toilet tissue configuration.

Toilet tissue dispensers are typically adapted to be wall mounted; in may cases adapted primarily to be physically integrated with a wall or tile structure during construction. Yet it is desirable, not only for reasons of economy but also for reasons of convenience, to have a portable, attractive, and economically manufacturable dispenser for rolled tissue so that this product can be used in a presentable and an attractive fashion as an alternative to the traditional facial tissue box.

BRIEF SUMMARY OF THE INVENTION

Briefly stated, the present invention is an attractive and economically manufactured dispenser for rolled toilet tissue and like material which is not limited to wall mounting but, rather, embodies the portability of the traditional facial tissue box.

In general, this is accomplished by providing a means for receiving and holding in an axially rotatable condition, a roll of toilet tissue or like material having a width X, and an outlet structure carried by the receiving and holding means adjacent the periphery of the rolled material and forming a material constricting outlet aperture of maximum lateral internal dimension less than the width X of the material whereby the material, when fed through the outlet, is deformed or "bunched" laterally.

In the preferred form, the dispenser comprises the combination of a molded plastic base and box-like cover and the outlet structure includes a bill-like projection which assists in the separation of the perforated tissues from one another.

BRIEF DESCRIPTION OF THE DRAWING

FIG. 1 is a perspective view of a first dispenser embodying the invention in a closed or fully assembled condition;

FIG. 2 is a perspective view of the device of FIG. 1 with the box-like cover removed to expose the internal details;

FIG. 3 is a sectional view of a detail of the device of FIGS. 1 and 2 showing in particular the manner in which the roll of material is mounted within the device;

FIG. 4 is a side sectional view of the device of FIGS. 1 and 2 illustrating in detail the manner in which the rolled material is fed through the outlet structure;

DETAILED DESCRIPTION OF THE SPECIFIC EMBODIMENT

Figure 6:
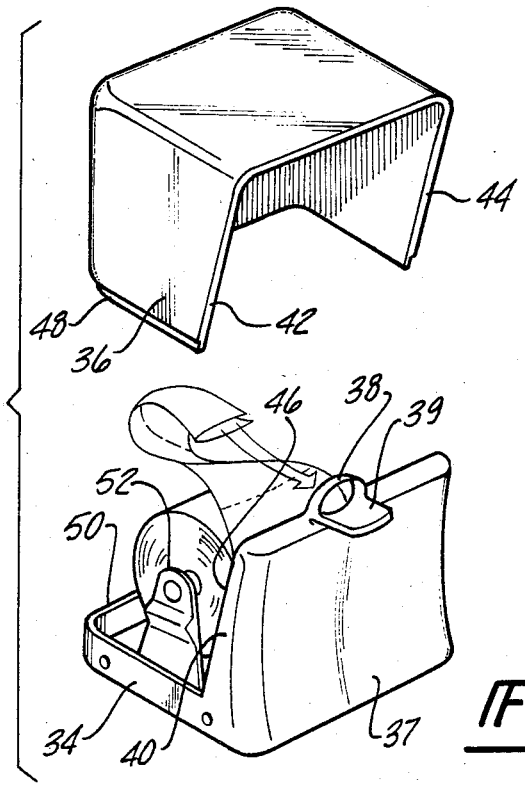
FIG. 6 is an exploded perspective view of the device of FIG. 5.

Referring now to the drawing, a dispenser 10 for paper tissue configured as a roll 12 of continuous but perforated sheets is shown to comprise a molded plastic base 14 and a box-like cover 16 having an opening 18 through which the sheets of rolled tissue are dispensed. Together the base 14 and cover 16 comprise a structure for receiving and holding in an axially rotatable condition the roll 12 of paper tissue.

Base 14 comprises a pair of axially spaced flexible plastic arms 20 which are parallel to one another and spaced apart to receive an axially rotatable condition the roll 12 of tissue. Depressed areas forming buttons 22 extend into the cardboard form upon which the roll 12 is typically mounted, the fit being loose enough to permit easy rotation of the roll about its own center axis.

The front wall 24 of the base 14 has formed thereon an outlet structure including a material-constricting ring 26, the maximum lateral internal dimension of which is substantially less than the width X of the paper roll 12 such that threading the tissues through the ring 26 causes the tissues to be laterally constricted such as by bunching or rolling, thereby not only to aim the tissue through the opening 18 but also to provide friction to prevent backup into the interior of the dispenser 10. Formed integrally with the ring 26 is a bill-like projection 28 over which the tissue from roll 12 passes. The projection 28 is preferably formed in a slightly concave shape; i.e. dished to permit the user to place a thumb or finger on the tissue and press it against the projection 28 to assist in the separation of the tissues along the line of perforation.

In operation, the user removes the cover 16 from the base 14 and snaps a roll 12 of perforated tissue paper onto the base between the upstanding arms 20. The tissue is, as shown in FIG. 2, threaded through the ring 26 and over the bill-like projection 28. Thereafter the box-like cover 16, which is also preferably molded plastic, is dropped down over the roll 12 until it comes to rest on the ledge 30 to improve the aesthetics of the dispenser 10. The tissue is pulled through the opening 18 in the box-like cover 16 whereupon the dispenser device is ready for use.

It will be appreciated that various departures from the specific structure shown in the drawing are possible. By way of example, the outlet ring 26 may be differently shaped and may be a partial rather than complete ring. Although the bill-like projection 28 is preferred, it is not an essential of the device. The arms 20 may be simply be provided with apertures and a conventional wooden roller may be mounted between them to receive the paper roll 12. Finally, the cover 16 and the base may be colored or printed or painted in a variety of colors, patterns, and textures to complement a variety of different decors.

Figure 5:
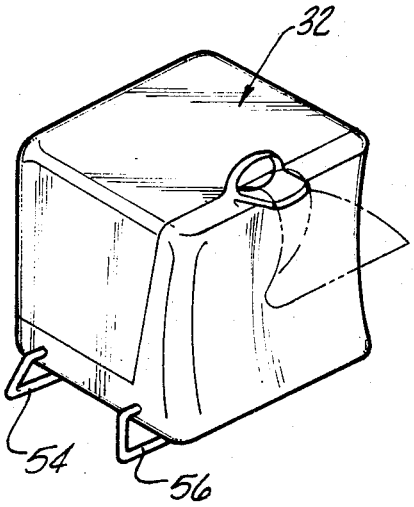
FIG. 5 is a perspective view of a second dispenser embodying the invention.

Looking now to FIGS. 5 and 6, a second embodiment of the invention is shown. In this embodiment the dispenser is represented generally by reference character 32 and comprises a molded plastic base 34 and a box-like cover 36 which together are adapted to receive and carry a roll of perforated tissue in the same fashion as was described with reference to the embodiment to FIGS. 1–4. The most notable difference between the two embodiments is the fact that the cover 36 is open on one end and interfits with an upstanding wall portion 37 of the base 34 to complete the enclosure for the roll.

More specifically, the upstanding and curved wall portion 37 is integral with molded base 34 and is provided with constriction ring 38 and a bill-like projection 39 corresponding generally to elements 26 and 28 of the first embodiment the wall portion 37 has orthogonally oriented partial side walls 40 the edges 46 of which mate with the edges 42 and 44 of the cover 36 while the bottom edges 48 of the cover rests on and telescopically interfits with the edge 50 of the base 34. Spring arms 52 receive the wooden doll for the rotational mounting of the tissue roll. As can be seen from FIGS. 5 and 6, wall portion 37 is angled outwardly and upwardly from molded base 34 to allow the operation of the invention no matter which way the tissue roll is mounted to rotate on the roller means.

As shown in FIG. 5 plastic or steel wire leg 54 and 56 may be snapped into the holes in base 34 if desired.

I claim:

1. A dispenser for rolled and perforated toilet tissue and like material comprising:

means for receiving and holding in an axially rotatable condition a roll of toilet tissue or like material having a width X, said receiving and holding means having a base and, integral therewith, at least one upstanding wall portion; and an outlet means carried by said wall portion adjacent said roll forming:

a material-constricting outlet aperture of maximum internal dimension less than X, integrally formed with said wall portion, whereby said material, when fed through said outlet, is bunched laterally; and a bill-like projection integral with said aperture-forming means which extends outwardly from the bottom of said aperture such that said material rides thereover as it is drawn from said dispenser;

said wall portion being angled outwardly and away from said roll of toilet tissue.

2. Apparatus as defined in claim 1 further comprising a box-like cover which fits on said base to cover said roll of material.

3. Apparatus as defined in claim 2 wherein said base and said cover are molded plastic.

4. Apparatus as defined in claim 2 wherein said outlet means is disposed on top of said wall portion.

5. Apparatus as defined in claim 4 wherein said box-like cover interfits in mating relation with said base and said wall portion to enclose a roll carried by said receiving and holding means.

6. Apparatus as defined in claim 2 further including support means attached to said base.

7. A dispenser for rolled and perforated toilet tissue comprising, in combination, two elements of molded plastic which interfit to form a six-sided, box-like enclosure, said first element forming a base portion and an upstanding front wall, integral therewith, said front wall angled outwardly from said base portion, and said base portion including means for holding in an axially rotatable condition a roll of toilet tissue having a width X, and said front wall including:

an integral annulus forming a material constricting aperture whose maximum internal dimension is less than X, whereby said material, when fed through said annulus, is bunched laterally, and a bill-like projection, integral with said annulus and said front wall, extending outwardly from the bottom of said annulus such that said toilet tissue rides thereover as it is drawn from said dispenser; and said second element forming an integral hood for said first element, including a top portion, two opposedly positioned side wall portions and a back wall portion.

8. The dispenser of claim 7 wherein said means for holding said roll of material is integral with said base portion.

9. The dispenser of claim 7 wherein said base portion includes means for supporting said dispenser at a convenient height above a floor.

* * * * *